US009843867B2

(12) United States Patent
Park et al.

(10) Patent No.: US 9,843,867 B2
(45) Date of Patent: Dec. 12, 2017

(54) MICROPHONE WITH SPECIFIC AUDIBLE AREA USING ULTRASOUND WAVE

(71) Applicant: POSTECH ACADEMY-INDUSTRY FOUNDATION, Pohang-si, Gyeongsangbuk-do (KR)

(72) Inventors: Hong June Park, Pohang-si (KR); Dong Hee Yeo, Pohang-si (KR); Seong Eun Cho, Pohang-si (KR); Young Jae Jang, Pohang-si (KR); Kyeong Won Jeong, Pohang-si (KR)

(73) Assignee: POSTECH ACADEMY-INDUSTRY FOUNDATION, Pohang-si, Gyeongsangbuk-Do (KR)

( * ) Notice: Subject to any disclaimer, the term of this patent is extended or adjusted under 35 U.S.C. 154(b) by 0 days.

(21) Appl. No.: 15/149,113

(22) Filed: May 7, 2016

(65) Prior Publication Data

US 2017/0188157 A1 Jun. 29, 2017

Related U.S. Application Data

(63) Continuation of application No. 15/070,569, filed on Mar. 15, 2016, now abandoned.

(30) Foreign Application Priority Data

Dec. 24, 2015 (KR) ..... 10-2015-0186081

(51) Int. Cl.
*H04R 17/10* (2006.01)
*H04R 3/06* (2006.01)

(52) U.S. Cl.
CPC ..... *H04R 17/10* (2013.01); *H04R 3/06* (2013.01); *H04R 2217/03* (2013.01)

(58) Field of Classification Search
CPC ..... H04R 17/10; H04R 3/06; H04R 2217/03
(Continued)

(56) References Cited

U.S. PATENT DOCUMENTS 4,337,527 A * 6/1982 Delagrange ..... H03G 3/3015 367/94
5,960,089 A * 9/1999 Bouricius ..... A61B 7/04 381/67
2006/0045287 A1* 3/2006 Abrams ..... H04R 1/08 381/77

FOREIGN PATENT DOCUMENTS

JP 2004-212121 7/2004
KR 10-2014-0140945 12/2014

* cited by examiner

*Primary Examiner* — Vivian Chin
*Assistant Examiner* — Douglas Suthers
(74) *Attorney, Agent, or Firm* — Kile Park Reed & Houtteman PLLC

(57) ABSTRACT

The present invention relates to a microphone with a specific audible area using ultrasound wave, which emits an ultrasound wave toward a sound source positioned in a specific area within a desired distance and a desired direction from the microphone, and extracts a sound signal in an audible frequency range, generated by the sound source, from an ultrasound wave reflected and received from the sound source. The microphone with a specific audible area using ultrasound wave can limit the audible area to an area within a specific angle from a half line starting from the microphone and a specific distance from the microphone, such that a user can selectively hear a desired sound in a noisy environment. When the microphone is applied to a hearing aid, the user can hear only the audible sound generated by the sound source located within the specific audible area in front of the user with the surrounding noise removed.

13 Claims, 6 Drawing Sheets

(58) Field of Classification Search
USPC ..... 381/122, 113
See application file for complete search history.

MICROPHONE WITH SPECIFIC AUDIBLE AREA USING ULTRASOUND WAVE

CROSS REFERENCE TO RELATED APPLICATIONS

This application is a continuation of U.S. patent application Ser. No. 15/070,569, filed on Mar. 15, 2016 (now pending), which claims priority to Korean Patent Application No. 10-2015-0186081, filed Dec. 24, 2015, the entire contents of which are incorporated herein by reference.

BACKGROUND

1. Technical Field

The present disclosure relates to a microphone, and more particularly, to a microphone with a specific audible area using ultrasound wave, which emits an ultrasound wave toward an audible sound source positioned in a specific area within a desired distance and a desired direction, using an ultrasound transducer, and extracts a sound signal in an audible frequency range, generated by the audible sound source, from an ultrasound wave reflected from the audible sound source, such that a user can selectively hear a desired sound even in a noisy environment. Hereafter, the audible sound source is referred to as sound source.

2. Related Art

Since an ultrasound wave is a sound wave with a higher frequency than a sound wave in the audible frequency range (hereafter, referred to as audible sound wave), they share many properties. Both ultrasound and audible sound waves have the same propagation velocity, and experience the same non-linear interaction while two sound waves are propagating through the same propagation path in the same propagation direction. The difference is that the ultrasound wave has a much shorter wavelength than the audible sound wave. Because of this wavelength difference, the ultrasound wave has an excellent going-straight property or propagates only in a predetermined direction compared to the audible sound wave. Thus, as energy is concentrated only in the predetermined direction during wave propagation, ultrasound wave can be focused toward the predetermined direction. Based on the non-linear interaction between two ultrasound waves propagating in the same direction, a directional speaker has been developed.

That is, one ultrasound wave with a certain center frequency is modulated with an audible sound signal and the other ultrasound wave with the same center frequency is not modulated, and then both modulated and unmodulated ultrasound waves with the same center frequency are transmitted in a specific direction, a user at a far distance in the corresponding direction can hear the original audible sound with his/her ears due to the non-linear interaction of two ultrasound waves However, this technology can be applied only to a speaker, but cannot be applied to a microphone. Thus, when a user intends to remove the influence of surrounding noise in a noisy environment and to selectively hear only desired sound, the technology cannot be applied.

PRIOR ART DOCUMENT

Patent Document

Korean Patent No. 10-0622078

SUMMARY

Various embodiments are presented in the present invention for a microphone with a specific audible area using ultrasound wave, which emits an ultrasound wave toward a sound source positioned in a specific area within a desired distance and a desired direction, and extracts an audible sound electrical signal corresponding to an audible sound wave generated by the sound source, from an ultrasound wave reflected from the sound source, such that a user can selectively hear a desired sound even in a noisy environment.

In an embodiment, there is provided a microphone with a specific audible area using ultrasound wave. The microphone may set an area within a desired distance and a desired direction to a specific audible area, and extract an audible sound electrical signal from an ultrasound wave which is reflected from a sound source in the specific audible area after the ultrasound wave is emitted by the microphone toward the sound source. The audible sound electrical signal corresponds to an audible sound wave which is generated by the sound source.

The microphone may include: a transmitter circuit unit configured to receive a square or sinusoidal electrical signal and amplify and output the received signal; an ultrasound transmitter configured to receive the output signal of the transmitter circuit unit, generate an ultrasound wave, and emit the generated ultrasound wave toward the sound source; an ultrasound receiver configured to receive the ultrasound wave reflected from the sound source and output an electrical signal; and a receiver circuit unit configured to receive the output signal of the ultrasound receiver and the square or sinusoidal electrical signal and extract the audible sound electrical signal.

DETAILED DESCRIPTION

Figure 1:
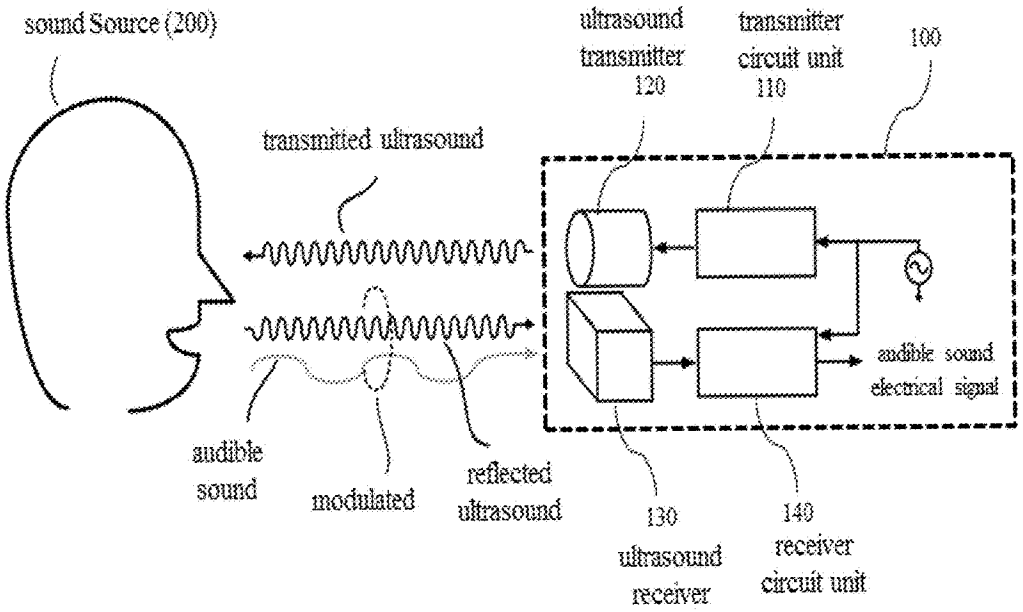
FIG. 1 is a diagram illustrating the configuration of a microphone with a specific audible area using ultrasound wave according to an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

Figure 2:
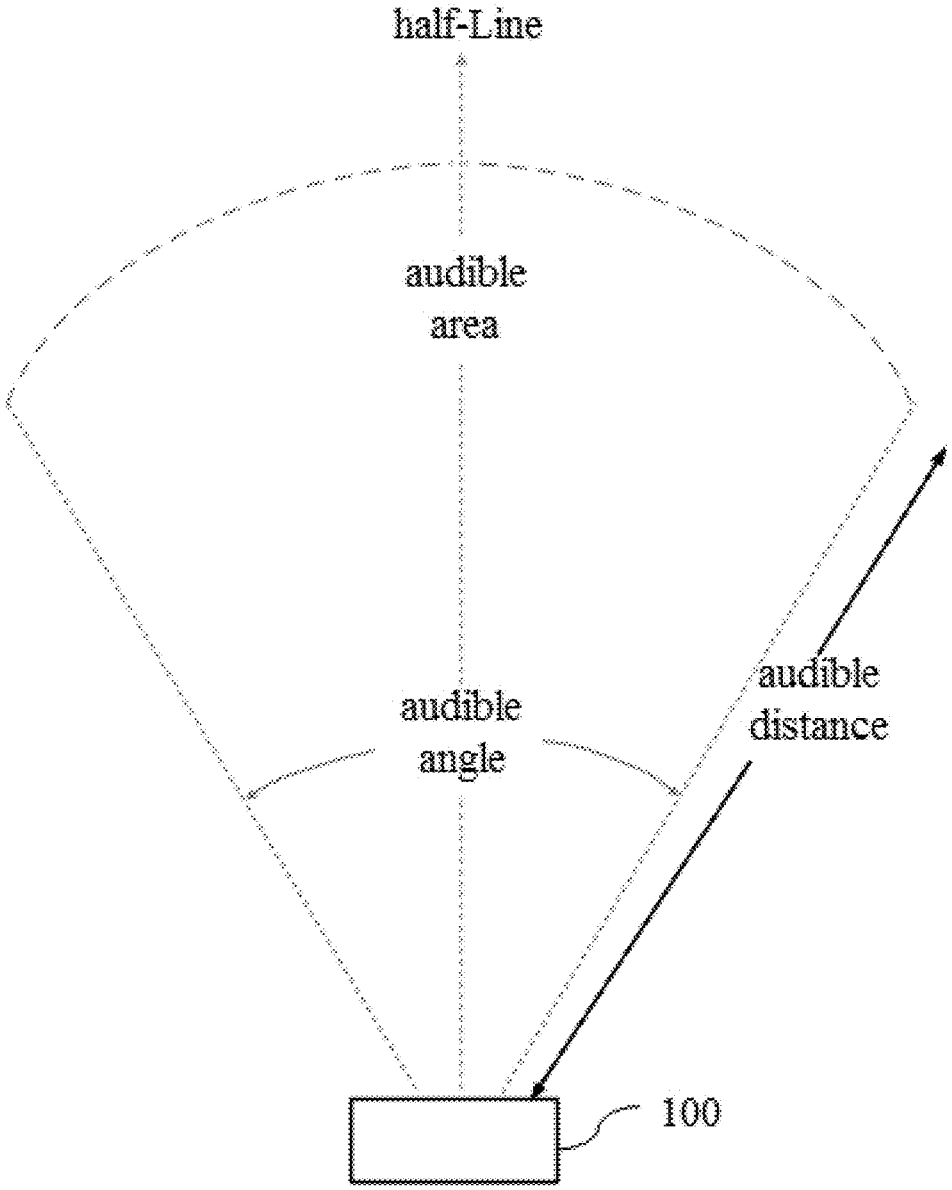
FIG. 2 is a diagram for describing an audible area of the microphone with a specific audible area using ultrasound wave according to the embodiment of the present invention.
Figure 5:
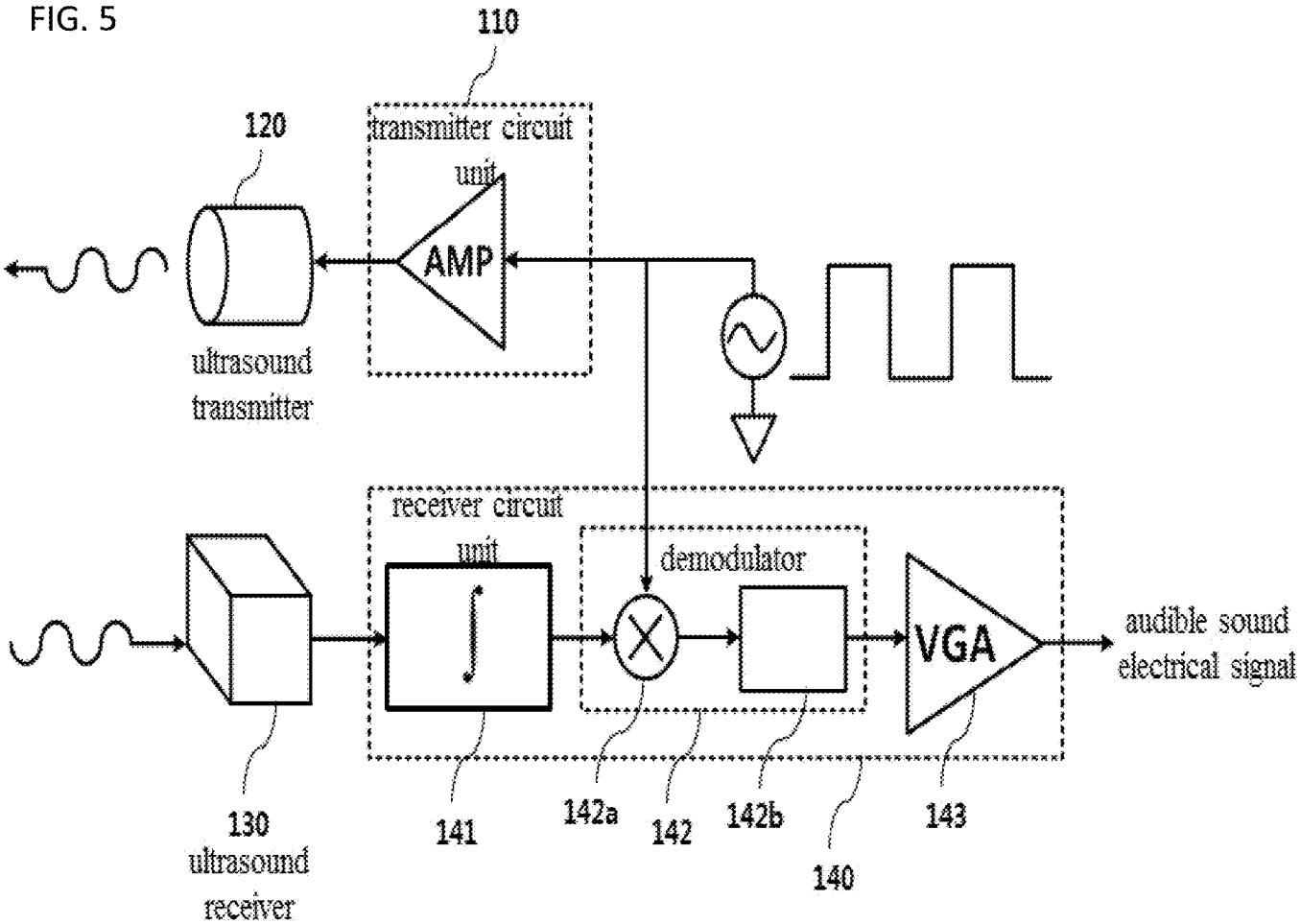
FIG. 5 is a detailed circuit diagram of the microphone with a specific audible area using ultrasound wave according to the embodiment of the present invention.

FIG. 1 is a diagram illustrating the configuration of a microphone with a specific audible area using ultrasound wave according to an embodiment of the present invention. FIG. 5 is a detailed circuit diagram of the microphone with a specific audible area using ultrasound wave according to the embodiment of the present invention. Furthermore, FIG. 2 is a diagram for describing an audible area of the microphone with a specific audible area using ultrasound wave according to the embodiment of the present invention.

Before the configuration of the microphone with a specific audible area using ultrasound wave according to the embodiment of the present invention is described, a process of using ultrasound wave and a method for limiting an audible area will be described.

The present invention is characterized in that ultrasound wave is used and an audible area is limited to a specific area, in order to implement a microphone.

That is, ultrasound wave is used in order to limit the audible area of the microphone to an area within a specific distance in a specific direction. The microphone according to the embodiment of the present invention emits CW (Continuous Wave) ultrasound, which is continuous with time, to a sound source using an ultrasound transmitter, and receives the ultrasound wave reflected from the sound source using an ultrasound receiver.

The ultrasound wave reflected from the sound source may be modulated by the audible sound wave generated by the sound source due to the non-linear interaction of two sound waves, while propagating from the sound source to the ultrasound receiver through the same propagation path at the same propagation velocity.

Due to the modulation, an ultrasound signal having the sum frequency ($\omega_u+\omega_a$) and the difference frequency ($\omega_u-\omega_a$) for the ultrasound frequency $\omega_u$ and the audible sound frequency $\omega_a$ are also received by the ultrasound receiver. Then, a receiver circuit unit extracts an audible sound electrical signal from an ultrasound electrical signal at the sum frequency and the difference frequency, using a demodulation circuit.

Since an ultrasound wave has an excellent going-straight property or reliably propagates in a specific direction, one can easily limit the direction of the audible area of the microphone by using an ultrasound wave.

As illustrated in FIG. 2, the specific audible area is limited to an area within the same specific angle in the left and right sides of one half-line starting from the microphone 100 and an area within a specific distance from the microphone 100.

The microphone with a specific audible area using ultrasound wave according to the embodiment of the present invention extracts an electrical signal only for the audible sound wave, which is generated within the specific audible area. For this operation, three properties of ultrasound wave, that is, the going-straight property, the attenuation property, and the non-linear interaction property with a sound wave are used.

Since both ultrasound and audible sound waves are sound waves, ultrasound and audible sound waves have the same propagation velocity, but have different frequencies. The audible sound has a frequency in the range from 20 Hz to 20 kHz, but the ultrasound wave has a frequency higher than 20 kHz. An ultrasound transducer which is frequently used for distance sensing has a center frequency of 40 kHz. Since the wavelength of sound is inversely proportional to the frequency, the ultrasound wave has a much shorter wavelength than the audible sound wave. Thus, an ultrasound goes straight when propagating. That is, since an ultrasound has a short wavelength, the propagation angle (beam width) of ultrasound wave can be maintained within 50°(±25°).

On the other hand, since an audible sound wave has a long wavelength, an audible sound wave has a large propagation angle. Furthermore, when a sound wave propagates, an attenuation constant increases in proportion to the frequency of the sound wave. Thus, the attenuation constant of ultrasound wave is much larger than that of audible sound wave. The attenuation constant of sound in the air per kHz is 0.164 dB/(kHz·meter). The microphone with a specific audible area using ultrasound wave according to the embodiment of the present invention limits the angle of the audible area using the going-straight property of ultrasound wave, and limits the distance of the audible area using the large attenuation property of ultrasound wave.

Next, the configuration and operation of the microphone with a specific audible area using ultrasound wave according to the embodiment of the present invention will be described.

Referring to FIGS. 1 and 5, the microphone 100 with a specific audible area using ultrasound wave according to the embodiment of the present invention includes a transmitter circuit unit 110, an ultrasound transmitter 120, an ultrasound receiver 130, and a receiver circuit unit 140.

The microphone 100 with a specific audible area using ultrasound wave according to the embodiment of the present invention emits an ultrasound wave toward a sound source 200, receives an ultrasound wave reflected from the sound source 200, and extracts an electrical signal (audible sound electrical signal) corresponding to the audible sound wave generated by the sound source 200, from the received ultrasound wave.

The transmitter circuit unit 110 receives a square or sinusoidal electrical signal at a constant frequency, and amplifies the received electrical signal to drive the ultrasound transmitter 120.

The ultrasound transmitter 120 may include an ultrasound transducer having a relatively large Q value. Furthermore, an existing ultrasound transducer, which has a center frequency ranging from 25 kHz to 250 kHz and is relatively cheap, may be used in the ultrasound transmitter 120.

The ultrasound transducer having a center frequency of 250 kHz or more cannot be applied to the microphone with a specific audible area using ultrasound wave according to the embodiment of the present invention, because the attenuation coefficient is as high as 41 dB/meter or more when a ultrasound wave with a center frequency of 250 kHz or higher propagates in the air. The Q value of the ultrasound transducer is obtained by dividing the center frequency by bandwidth. The ultrasound transducer having a frequency bandwidth range of 40±1.25 kHz has a Q value of 16 (=40/2.5).

In order to increase the signal-to-noise ratio (SNR) of an output electrical signal of the ultrasound receiver 130, the ultrasound receiver 130 must reliably detect only an ultrasound wave signal in a frequency band close to the center frequency of the ultrasound transducer used in the ultrasound transmitter 120, and must not respond to sound wave signals in other frequency bands.

Thus, an ultrasound transducer having the same center frequency as the ultrasound transducer used in the ultrasound transmitter 120 may be used in the ultrasound receiver 130. However, since a typical ultrasound transducer has a high Q value and hence a small frequency bandwidth, the frequency bandwidth of an output signal of the microphone according to the embodiment of the present invention is limited and degrades the quality of the extracted audible sound signal.

In the case of an ultrasound transducer having a center frequency of 40 kHz and a propagation angle (beam width) of 50°(±25°), the frequency bandwidth range is usually 40±1.25 kHz. Thus, when the ultrasound transducer is used in the ultrasound receiver 130, the frequency bandwidth of the microphone output signal is limited to a narrow range of 0 to 1.25 kHz. Therefore, it is desirable to use an ultrasound transducer having a frequency bandwidth range of (center frequency ±5 kHz) in the ultrasound receiver 130 according to the embodiment of the present invention.

In this case, the frequency bandwidth of the microphone output signal spans the range of 0 to 5 kHz, and the microphone may be used for an application such as a hearing aid. To maximize the frequency bandwidth of the microphone output signal, the center frequency of the ultrasound transducer used in the ultrasound receiver 130 should be equal to the center frequency of the ultrasound transducer used in the ultrasound transmitter 120. When the center frequency of the ultrasound transducer used in the ultrasound transmitter 120 becomes equal to or less than 25 kHz, the ultrasound wave can be transmitted to a far distance because of small attenuation during propagation. However, it is difficult for the ultrasound receiver 130 to secure a frequency bandwidth of 5 kHz.

The ultrasound transmitter 120 emits an ultrasound wave, which is continuous with time, toward the sound source. Then, the ultrasound wave is reflected from the sound source, and a part of the reflected ultrasound wave propagates along the straight path from the sound source to the ultrasound receiver 130 of the microphone. Furthermore, a part of the audible sound generated by the sound source also propagates along the straight path from the sound source to the ultrasound receiver 130. Therefore, the part of the ultrasound wave reflected from the sound source and the part of the audible sound wave generated by the sound source propagate through the same path at the same propagation velocity.

Figure 3:
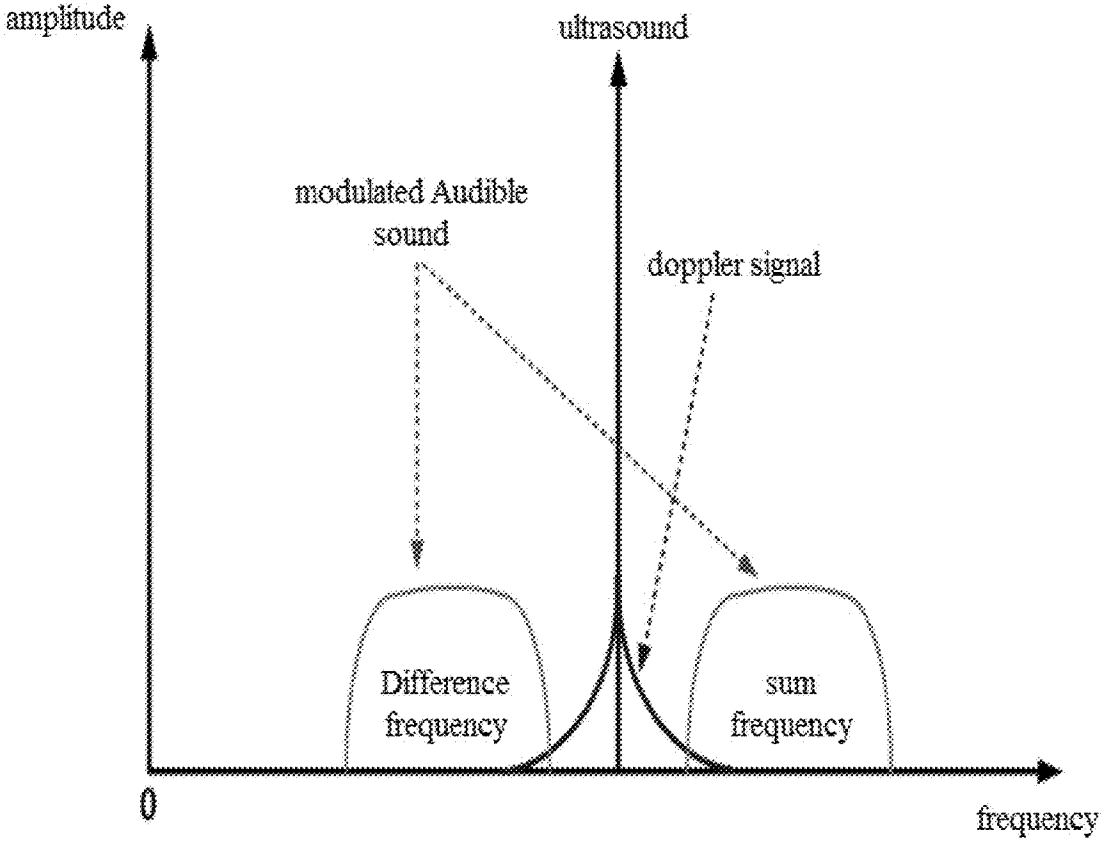
FIG. 3 is a diagram for describing frequency components of an ultrasound receiver output signal of the microphone with a specific audible area using ultrasound wave according to the embodiment of the present invention.

During this process, modulation occurs in the reflected ultrasound wave due to the non-linear interaction between the reflected ultrasound wave and the audible sound wave. As illustrated in FIG. 3, signal components having the sum frequency ($\omega_u+\omega_a$) and the difference frequency ($\omega_u-\omega_a$) are generated by modulation in the reflected ultrasound wave for the ultrasound frequency $\omega_u$ and the audible sound frequency $\omega_a$.

The receiver circuit unit 140 extracts an audible sound electrical signal, corresponding to the audible sound wave generated by the sound source, from the ultrasound electrical signal corresponding to the sum frequency and the difference frequency among output electrical signals of the ultrasound receiver 130, using a demodulator. Due to the Doppler effect caused by a physical motion of the sound source, a Doppler signal with a low frequency in the range from 20 Hz to 150 Hz may appear in the output of the demodulator 142. Since the frequency band of the Doppler signal is located in the lower side of the audible frequency band, the Doppler signal can be easily removed through a filter 142*b* in the demodulator 142 of the receiver circuit unit 140.

Figure 4:
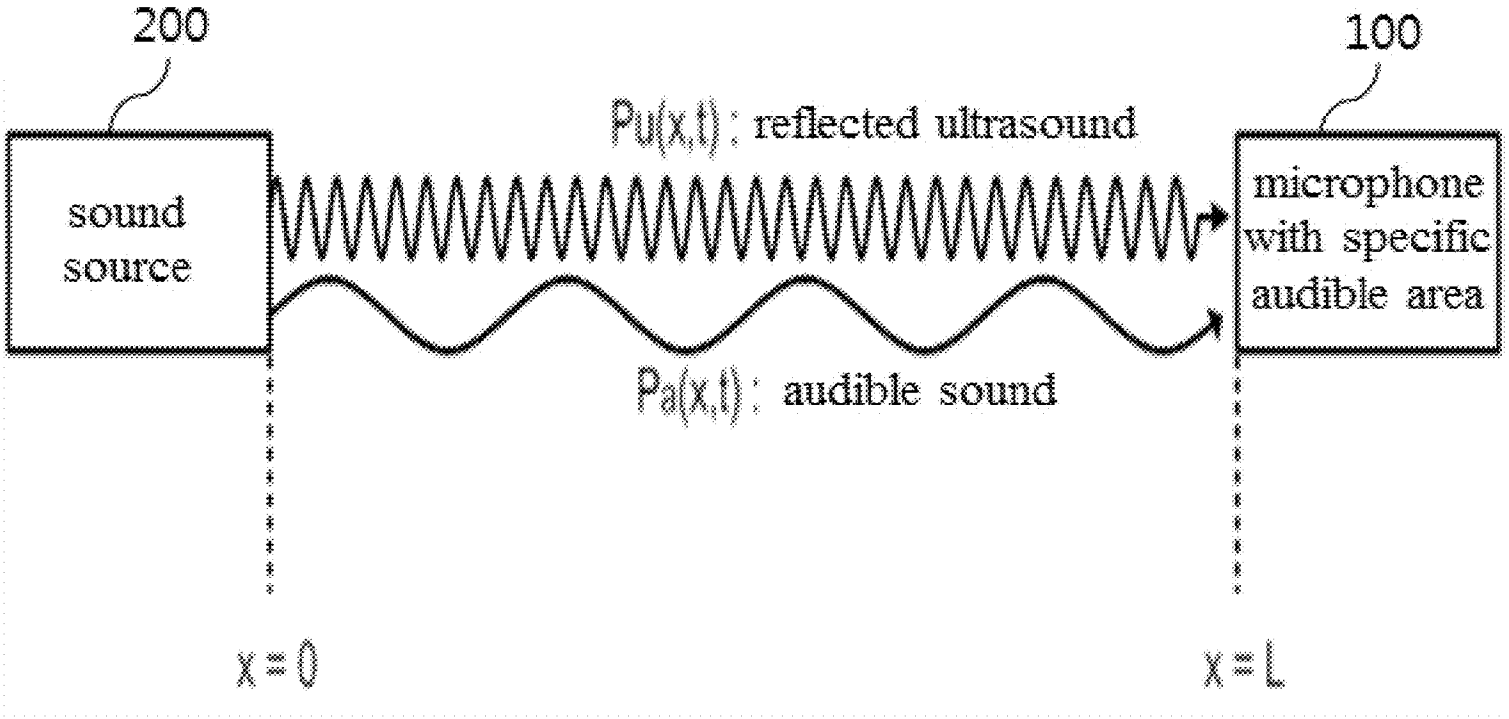
FIG. 4 is a diagram for describing the non-linear interaction of an ultrasound wave reflected from a sound source and an audible sound wave generated by the sound source while these two sound waves are propagating through the same propagation path in the same propagation direction in the microphone with a specific area using ultrasound wave according to the embodiment of the present invention.

FIG. 4 is a diagram for describing the non-linear interaction between two sound saves. One sound wave is an ultrasound wave $P_u(x, t)$ which is reflected from the sound source and the other sound wave is an audible sound wave $P_a(xt)$ which is generated by the sound source.

While the ultrasound wave $P_u(x, t)$ and the audible sound wave $P_a(x, t)$ propagate at the same propagation velocity in the same direction along the same path, a new ultrasound wave $P_s(x, t)$ is generated by modulation due to the non-linear interaction between sound waves.

The non-linear interaction property of sound waves may be expressed as the Westervelt equation which is publicly known. When the Westervelt equation is simplified in order to apply the equation to the microphone with a specific area using ultrasound wave according to the embodiment of the present invention, Equation 1 below may be established. In the present embodiment, the non-linear interaction between one ultrasound wave $P_u(x, t)$ and one audible sound wave $P_a(x, t)$ will be taken as an example to generate a modulated ultrasound wave $P_s(x, t)$.

$$\frac{\partial^2 P_s(x,t)}{\partial x^2} - \frac{1}{c_0^2}\frac{\partial^2 P_s(x,t)}{\partial t^2} = -\frac{\beta}{\rho_0 c_0^4}\cdot\frac{\partial^2\{P_u(x,t)+P_a(x,t)\}^2}{\partial t^2} \quad \text{[Equation 1]}$$

In Equation 1, x represents a distance from the sound source along the propagation path, t represents time, $P_s(x, t)$ $P_u(x, t)$ and $P_a(x, t)$ represent the sound pressure per unit volume of the modulated ultrasound wave, the reflected ultrasound wave and the audible sound wave, respectively, $c_0$ represents the propagation velocity of sound wave in the air, $\beta$ represents the coefficient for non-linear interaction (about 1.2) of the air, and $\rho_0$ represents the density of the air. The square term in the numerator at the right end of Equation 1 causes modulation due to the non-linear interaction. When the frequency, the attenuation constant and the amplitude of a sinusoidal ultrasound wave pressure $P_u(x, t)$ are represented by $\omega_u$, $\alpha$, and $A_u$, respectively, and the frequency and the amplitude of a sinusoidal audible sound wave pressure $P_a(x, t)$ are represented by $\omega_a$ and $A_a$, respectively, $P_u(x, t)$ and $P_a(x, t)$ are expressed as Equations 2 and 3, respectively. $P_u(x, t)$ represents the sound pressure of the ultrasound wave reflected from the sound source and $P_a(x, t)$ represents the sound pressure of the audible sound wave generated by the sound source.

$$P_u(x,t) = A_u\cdot e^{-\alpha x}\cdot\sin\left\{\omega_u\left(t-\frac{x}{c_0}\right)\right\} \quad \text{[Equation 2]}$$

$$P_a(x,t) = A_a\cdot\sin\left\{\omega_a\left(t-\frac{x}{c_0}\right)\right\} \quad \text{[Equation 3]}$$

Since the audible sound wave pressure $P_a(x, t)$ has a low frequency, attenuation may be ignored. When Equations 2 and 3 are substituted for Equation 1, the modulated ultrasound wave pressure $P_s(x=L, t)$ transmitted to the ultrasound receiver 130 is calculated through Equation 4 below. Here, L represents a distance from the sound source to the microphone.

$$P_s(L,t) = -\frac{\beta p_s^2 r^2 A_u A_a}{4\rho_0 c_0^4 \alpha L}\cdot \frac{\partial^2}{\partial t^2}\left[\cos\left\{(\omega_u+\omega_a)\left(t-\frac{L}{c_0}\right)\right\} - \cos\left\{(\omega_u-\omega_a)\left(t-\frac{L}{c_0}\right)\right\}\right] \quad \text{[Equation 4]}$$

In Equation 4, r represents the radius of the beam width of the reflected ultrasound wave. In order to extract an audible sound signal $P_a(L, t)$ from the modulated ultrasound signal $P_s(L, t)$ of Equation 4, an output signal of the ultrasound receiver 130 is passed through a demodulator 142 of the receiver circuit unit 140.

Referring to FIG. 5, the receiver circuit unit 140 of the microphone with a specific audible area according to the embodiment of the present invention includes an integrator block 141, a demodulator 142, and a variable gain amplifier 143.

The demodulator 142 includes a chopper circuit 142*a* and a band-pass filter 142*b*. The chopper circuit 142*a* multiplies $P_s(L, t)$ by a square or sinusoidal electrical signal having the same frequency and the same phase as $$\sin\left\{\omega_u\left(t-\frac{t}{c_0}\right)\right\}.$$

The output signal of the ultrasound receiver 130 contains frequency components such as $\omega_u$, $2\omega_u$, $2\omega_a$, and 0(DC), in addition to $(\omega_u+\omega_a)$ and $(\omega_u-\omega_a)$ as can be derived from Equation 4. When the output signal is passed through the chopper circuit 142*a* and the band-pass filter 142*b*, only two frequency components $(\omega_u+\omega_a)$ and $(\omega_u-\omega_a)$ are converted into the audible frequency $\omega_a$, and the other frequency components are removed in the output signal of the demodulator 142.

In order to generate the square or sinusoidal electrical signal having the same frequency and the same phase as $$\sin\left\{\omega_u\left(t-\frac{t}{c_0}\right)\right\}$$

to be multiplied by $P_s(L, t)$ in the receiver circuit unit 140, the input electrical signal of the transmitter circuit unit 110 needs to be delayed by a proper amount of time. For this operation, a necessary delay time is extracted from the ultrasound signal received by the ultrasound receiver 130. Otherwise, a quadrature demodulation can be performed in the demodulator 142 to compensate for the time delay between $P_s(L, t)$ and the pulse or sinusoidal signal input of the demodulator 142. That is, $P_s(L, t)$ are multiplied by the in-phase and quadrature signals of the input signal of the transmitter circuit unit 110 by using two chopper and two band-pass filters in the demodulator 142, and then the two band-pass filter output signals are processed appropriately to extract the audible sound signal.

Since $P_s(L, t)$ of Equation 4 includes a second derivative term with respect to time, an analog integrator block 141 is arranged at the initial stage of the receiver circuit unit 140, in order to compensate for the second derivative term. Two analog integrators may be arranged in series in the analog integrator block 141, but the number of analog integrators may be adjusted according to the frequency characteristic of the ultrasound receiver 130.

The variable gain amplifier 143 amplifies an output of the demodulator 142 and outputs the amplified signal as an audible sound electrical signal.

Figure 6:
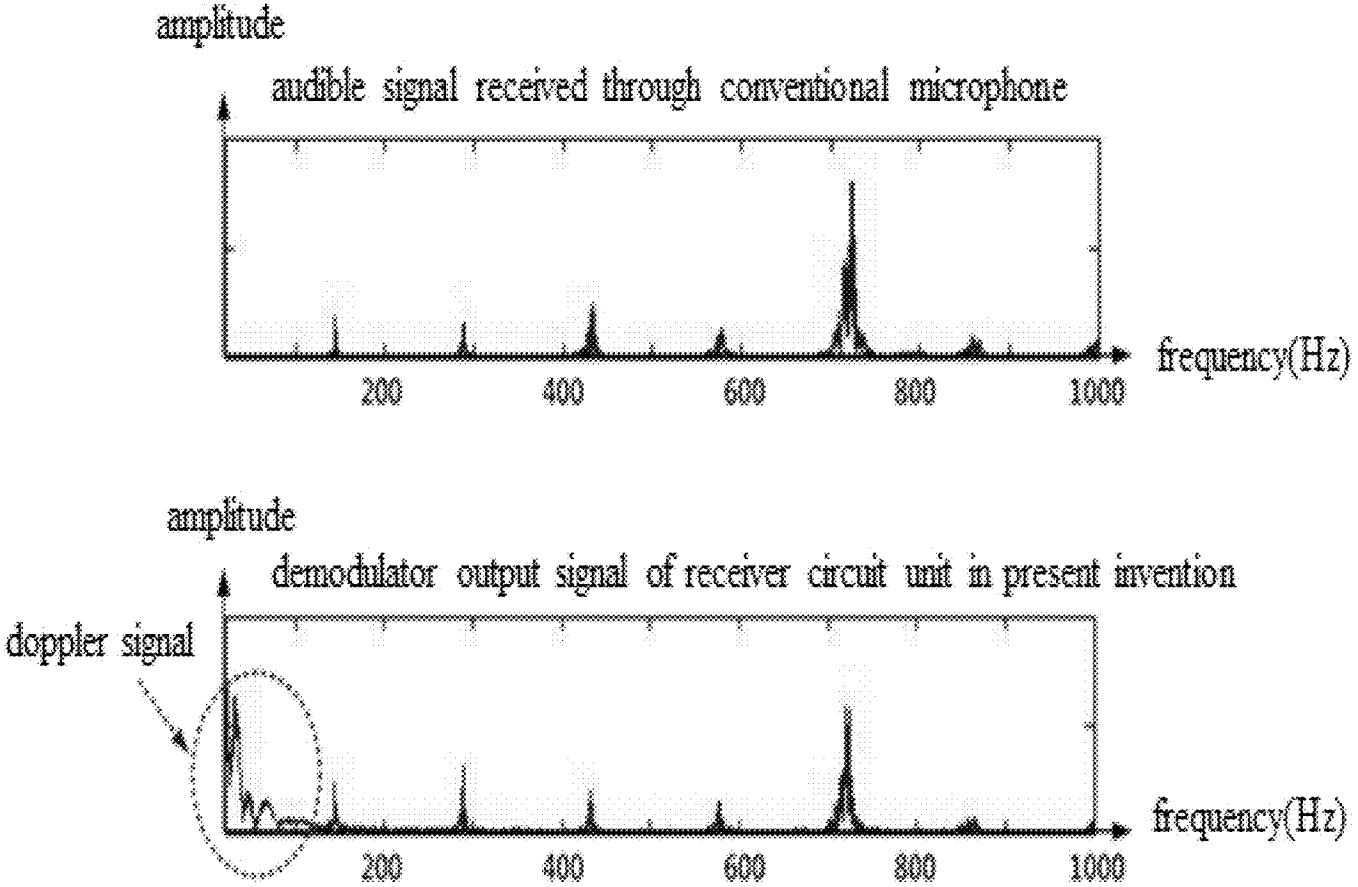
FIG. 6 is a diagram which compares the frequency spectrums of an output signal of the conventional microphone and a demodulator output signal of the receiver circuit unit of the microphone with a specific audible area using ultrasound wave according to the embodiment of the present invention.

FIG. 6 is a diagram which compares the measured frequency spectrums of an output signal of the conventional microphone and an output signal of the microphone with a specific audible area using ultrasound wave according to the embodiment of the present invention. This comparison was done to find the feasibility of the microphone with a specific audible area according to the embodiment of the present invention.

That is, the frequency spectrum of a demodulator output signal of the receiver circuit unit 140l of the microphone having the circuit configuration of FIG. 5 was compared to the frequency spectrum of an output signal of the conventional microphone, when a user made a vowel sound "Aaah . . . . " at a distance of 50 cm from each of the two microphones.

Referring to FIG. 6, frequency formants caused by the vowel "Aaah" are equal to each other in the two spectrums. However, due to the Doppler effect caused by a physical motion of the sound source (the user's lips and head), noise is generated in the low-frequency band from 20 Hz to 150 Hz in the demodulator output signal of the receiver circuit unit 140 of the microphone according to the embodiment of the present invention. This noise is not directly related to the audible sound wave generated by the sound source.

In order to remove the low-frequency noise caused by the Doppler effect, the lower limit of the pass-band frequency of the band-pass filter 142*b* of the demodulator 142 may be set to around 150 Hz. Thus, the band-pass filter 142*b* may pass the signals in the frequency range from 150 Hz to 5 kHz.

In FIG. 6, the same kinds of ultrasound transducers are used for the ultrasound transmitter 120 and the ultrasound receiver 130 of the microphone with a specific audible area according to the embodiment of the present invention That is, the two ultrasound transducers have the same center frequency of 40 kHz and the same frequency bandwidth range of 40±1.25 kHz, and the same propagation angle (beam width) of) 50°(±25°).

When the propagation angle is too narrow, such as) 10°(±5°) or less, in the ultrasound transmitter 120 and the ultrasound receiver 130 of the microphone according to the embodiment of the present invention, the microphone fails to track the sound source in the audible area even when the sound source slightly moves, which makes a user feel inconvenient to use the microphone. Furthermore, when the propagation angle is too wide, such as) 90°(±45°) or more, surrounding noise is significantly contained in the output signal of the microphone, which also makes a user feel inconvenient to use the microphone. Thus, the propagation angle of the ultrasound transmitter 120 and the ultrasound receiver 130 of the microphone according to the embodiment of the present invention may be set in the range from 10°(±5°) to 90°(±45°).

According to the embodiment of the present invention, the microphone with a specific audible area using ultrasound wave may limit the audible area to an area within a specific angle and a specific distance from the microphone, such that a user can selectively hear a desired sound in a noisy environment. When the microphone is applied to a hearing aid, surrounding noise may be removed, and the user can hear only the audible sound generated by the sound source located in front of the user with the hearing aid.

While various embodiments have been described above, it will be understood to those skilled in the art that the embodiments described are by way of example only. Accordingly, the disclosure described herein should not be limited based on the described embodiments.

What is claimed is:

1. A microphone with a specific audible area using an ultrasound wave, the microphone comprising:

a receiver circuit unit configured to extract an audible sound electrical signal from the ultrasound wave which is reflected from a sound source in the specific audible area after the ultrasound wave is emitted toward the sound source, with the audible sound electrical signal corresponding to an audible sound wave in an audible frequency range, generated by the sound source, wherein the specific audible area is an area within a desired distance and within an angle of a desired direction from the microphone to the specific audible area; and a transmitter circuit unit configured to receive a square or sinusoidal electrical signal, amplify the received signal, and output the amplified received signal, wherein the transmitter circuit unit controls the desired distance of the specific audible area by adjusting an amplitude of an output voltage of the output amplified output signal of the transmitter circuit unit.

2. The microphone of claim 1, further comprising:

an ultrasound transmitter configured to receive the output signal of the transmitter circuit unit, generate the ultrasound wave, and emit the generated ultrasound wave toward the sound source;

an ultrasound receiver configured to receive the ultrasound wave reflected from the sound source and output an electrical signal, wherein the receiver circuit unit is further configured to receive the output signal of the ultrasound receiver and the square or sinusoidal electrical signal.

3. The microphone of claim 2, wherein the microphone extracts the audible sound electrical signal from the ultrasound wave reflected from the sound source, using a phenomenon that the ultrasound wave reflected from the sound source is modulated by the audible sound wave generated by the sound source due to a non-linear interaction between the ultrasound wave and the audible sound wave, while the ultrasound wave and the audible sound wave are propagating from the sound source to the microphone through a same propagation path at a same propagation velocity.

4. The microphone of claim 3, wherein the microphone extracts the audible sound electrical signal from signals corresponding to a sum frequency and a difference frequency between a frequency of the ultrasound wave signal reflected from the sound source and a frequency of the audible sound wave signal.

5. The microphone of claim 4, wherein the receiver circuit unit comprises:

an integrator block configured to process the output signal of the ultrasound receiver and output an ultrasound electrical signal;

a demodulator configured to receive the output signal of the integrator block and the square or sinusoidal electrical signal and extract the audible sound electrical signal; and a variable gain amplifier configured to amplify an output signal of the demodulator.

6. The microphone of claim 5, wherein the microphone comprises one or more integrators in the integrator block.

7. The microphone of claim 5, wherein the demodulator comprises:

a chopper circuit configured to multiply the output signal of the integrator block by the square or sinusoidal electrical signal; and a filter configured to remove a low-frequency signal component generated by a Doppler effect caused by a physical motion of the sound source and a signal component having a higher frequency than the audible frequency range from an output signal of the chopper circuit.

8. The microphone of claim 7, wherein the filter comprises a band-pass filter.

9. The microphone of claim 5, wherein the audible sound electrical signal is extracted by demodulating the ultrasound electrical signal which is modulated by a non-linear interaction between the ultrasound wave and the audible sound wave.

10. The microphone of claim 2, wherein the specific audible area is set to an area within a same predetermined angle in a left side and a right side of a one half-line starting from the microphone and within a predetermined distance from the microphone.

11. The microphone of claim 10, wherein the predetermined angle ranges from 5 to 45 degrees.

12. The microphone of claim 2, wherein the ultrasound receiver comprises an ultrasound transducer which has a frequency bandwidth range equal to or wider than a center frequency ±5kHz.

13. The microphone of claim 2, wherein the ultrasound transmitter comprises an ultrasound transducer having a center frequency in the range from 25 kHz to 250 kHz.

* * * * *